US008272725B2

(12) United States Patent
Tsukamura

(10) Patent No.: US 8,272,725 B2
(45) Date of Patent: Sep. 25, 2012

(54) LIQUID CONTAINER, LIQUID DROPLET DISCHARGING DEVICE, AND IMAGE FORMING APPARATUS

(75) Inventor: Kiyoshi Tsukamura, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 292 days.

(21) Appl. No.: 12/790,012

(22) Filed: May 28, 2010

(65) Prior Publication Data

US 2010/0302327 A1 Dec. 2, 2010

(30) Foreign Application Priority Data

May 28, 2009 (JP) ..... 2009-128566

(51) Int. Cl.
*B41J 2/175* (2006.01)

(52) U.S. Cl. ..... 347/86

(58) Field of Classification Search ..... 347/84, 347/85, 86, 87

See application file for complete search history.

(56) References Cited

U.S. PATENT DOCUMENTS

| | | | | |
|---|---|---|---|---|
| 7,325,908 | B2 * | 2/2008 | Katoh et al. | 347/85 |
| 7,540,598 | B2 * | 6/2009 | Hori et al. | 347/86 |
| 7,562,972 | B2 * | 7/2009 | Hattori et al. | 347/86 |
| 7,871,158 | B2 * | 1/2011 | Kaneko | 347/86 |
| 2007/0247026 | A1 | 10/2007 | Tsukamura et al. | |
| 2008/0136874 | A1 | 6/2008 | Tsukamura | |
| 2009/0141103 | A1 * | 6/2009 | Takagi | 347/86 |

FOREIGN PATENT DOCUMENTS

| | | | |
|---|---|---|---|
| JP | 2002-103644 | | 4/2002 |
| JP | 2003-89217 | | 3/2003 |
| JP | 2005-138472 | * | 6/2005 |
| JP | 4151939 | | 7/2008 |
| JP | 4298474 | | 4/2009 |

* cited by examiner

*Primary Examiner* — Huan Tran
(74) *Attorney, Agent, or Firm* — Cooper & Dunham LLP

(57) ABSTRACT

A liquid container including a container body to store a liquid, a pressure release mechanism to open and close a pressure release path in the container body, and a fixing member to fix a holder of the pressure release mechanism to a cylindrical holder mounting part of the container body by being inserted into each of a mounting portion of the holder and a mounting portion of the cylindrical holder mounting part from a horizontal direction perpendicular to positions of multiple hooks provided to the container body while the holder including a valve mechanism is inserted into the cylindrical holder mounting part.

11 Claims, 14 Drawing Sheets

LIQUID CONTAINER, LIQUID DROPLET DISCHARGING DEVICE, AND IMAGE FORMING APPARATUS

BACKGROUND

1. Technical Field

This disclosure relates generally to a liquid container that stores a liquid such as ink to supply the ink to a recording head and so forth that discharges the ink as droplets from, for example, nozzles of the recording head onto a recording medium to form an image on the recording medium. This disclosure further relates generally to a liquid droplet discharging device including the liquid container, and an image forming apparatus including the liquid droplet discharging device.

2. Description of the Background

Related-art image forming apparatuses such as copiers, printers, facsimile machines, and multifunction devices having two or more of copying, printing, and facsimile functions include inkjet-type image forming apparatuses employing a liquid discharge recording method. Based on image data, such inkjet-type image forming apparatuses discharge ink droplets from nozzles of recording heads onto a recording medium such as a sheet of paper to form an image on the sheet.

Inkjet-type image forming apparatuses generally include a large-capacity main cartridge or main tank in a main body thereof. Ink or other such recording liquid is supplied from the main tank to a small-capacity sub-tank to replenish the small-capacity sub-tank, which serves as a recording liquid container provided on a carriage and supplies ink to the recording heads. Alternatively, inkjet-type image forming apparatuses may include an ink cartridge itself serving as the recording liquid container that can be replaced with a new ink cartridge together with the recording head.

Inkjet-type image forming apparatuses having the sub-tank are further supplied with a supply tube through which the ink is supplied from the main tank to the sub-tank and a flexible film member serving as a damper that prevents pressure fluctuation in the sub-tank. Long-term use of the supply tube and the flexible film member gradually allows penetration of air, and eventually, the air accumulates within the sub-tank. Further, a slight amount of air enters the main tank due to attachment and detachment of the main tank to and from the main body of the inkjet-type image forming apparatuses. Ultimately, the air within the main tank enters the sub-tank as the ink is supplied from the main tank to the sub-tank.

Published Unexamined Japanese Patent Application No. 2005-138472 (hereinafter referred to as JP-2005-138472-A) discloses a pressure release mechanism that releases air from a sub-tank. FIG. 1 is a vertical cross-sectional view illustrating a configuration of a pressure release mechanism 400 disclosed in JP-2005-138472-A. The pressure release mechanism 400 is detachably attached to a container body 501 that stores ink supplied to the sub-tank, and includes a holder 402 having, at a leading edge thereof, a pressure release hole 401 connected to an air flow path 503 within the container body 501. The holder 402 includes a valve seat 423 composed as a cylindrical gasket, a ball 424 serving as a valve movable to contact to and separate from the valve seat 423, a coil spring 425 that biases the ball 424 against the valve seat 423, and a biasing pin 427. One end of the biasing pin 427 protrudes outward from the pressure release hole 401 and the other end of the biasing pin 427 faces the ball 424. The biasing pin 427 is pressed by a pressure release pin 601 driven by an external drive unit so as to contact the ball 424 and move the ball 424 away from the valve seat 423 to release air from the sub-tank.

Although the above-described configuration is generally successful, during mounting within the holder 402 the valve seat 423 is compressed in both radial and surficial directions thereof. Consequently, when the center of the pressure release hole 401 of the holder 402 and the center of the cylindrical valve seat 423 are not perfectly aligned, an inner diameter of the valve seat 423 is deformed, and the valve seat 423 does not completely contact the ball 424, allowing air to leak. As a result, negative pressure is not kept in the sub-tank, resulting in irregular discharge of ink droplets.

Although a contact state or seal between the ball 424 and the valve seat 423 may be tested by a pressure proof test and so forth, even an unstable seal between the ball 424 and the valve seat 423 may pass the pressure proof test because the test is performed only once.

Further, because the holder 402 including the valve seat 423, the ball 424, and the coil spring 425 is rotated to be attached to the container body 501, the valve seat 423 included in the holder 402 may be twisted upon attachment of the holder 402 to the container body 501, degrading the seal between the ball 424 and the valve seat 423.

A pick may be provided to the holder 402 to attach the holder 402 to the container body 501 without rotating the holder 402. However, because pressure applied to the valve seat 423 caused by pressure from the ball 424 pressed by the coil spring 425 is constantly applied to the pick, thermal deformation or deterioration of the pick may occur over time, resulting in insufficient stability of attachment of the holder 402 to the container body 501.

SUMMARY

In this disclosure, a liquid container including a pressure release mechanism is provided to achieve stable contact between a valve and a valve seat both included in the pressure release mechanism so that the pressure release mechanism operates reliably. In addition, a liquid droplet discharging device including the liquid container and an image forming apparatus including the liquid droplet discharging device are provided in this disclosure.

In one illustrative embodiment, a liquid container includes a container body to store a liquid, a pressure release mechanism to open and close a pressure release path in the container body, and a fixing member. The container body includes the pressure release path to connect a release path and the pressure release mechanism, a cylindrical holder mounting part having the pressure release path therein to which the pressure release mechanism is attached, multiple hooks provided at vertically opposed positions outside the cylindrical holder mounting part with the cylindrical holder mounting part interposed therebetween, and the release path formed within the container body to release pressure from the container body. The pressure release mechanism includes a pressure communicating part to communicate with air through a filter member, and the holder attached to the cylindrical holder mounting part. The holder includes a pressure path to connect the pressure release path and the pressure communicating part, and a valve mechanism to open and close the pressure path. The valve mechanism includes a cylindrical valve seat to contact a valve seat holding member, a valve to contact an inner diameter of the valve seat, an elastic member to press the valve against the valve seat, and a biasing pin inserted into the pressure path. One end of the biasing pin contacts the valve. The valve seat holding member has an opening through which the pressure path passes, and is provided on a wall surface of the holder opposite a wall surface thereof to be attached to the cylindrical holder mounting part. The fixing member fixes the holder to the cylindrical holder mounting part by being inserted into each of a mounting portion of the holder and a mounting portion of the cylindrical holder mounting part from a horizontal direction perpendicular to the positions of the hooks while the holder including the valve mechanism is inserted into the cylindrical holder mounting part.

In another illustrative embodiment, a liquid droplet discharging device includes the liquid container described above and a liquid droplet discharging head that discharges liquid droplets to supply a liquid from the liquid container to the liquid droplet discharging head. The liquid container and the liquid droplet discharging head are formed as a single integrated unit.

In yet another illustrative embodiment, an image forming apparatus includes a carriage and the liquid droplet discharging device described above. The liquid droplet discharging device is installed on the carriage, and the liquid droplet discharging head discharges ink onto a recording medium to form an image on the recording medium.

Additional aspects, features, and advantages of the present disclosure will be more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein like reference numerals designate identical or corresponding parts throughout the several views and wherein.

DETAILED DESCRIPTION OF THE ILLUSTRATIVE EMBODIMENTS

Figure 1:
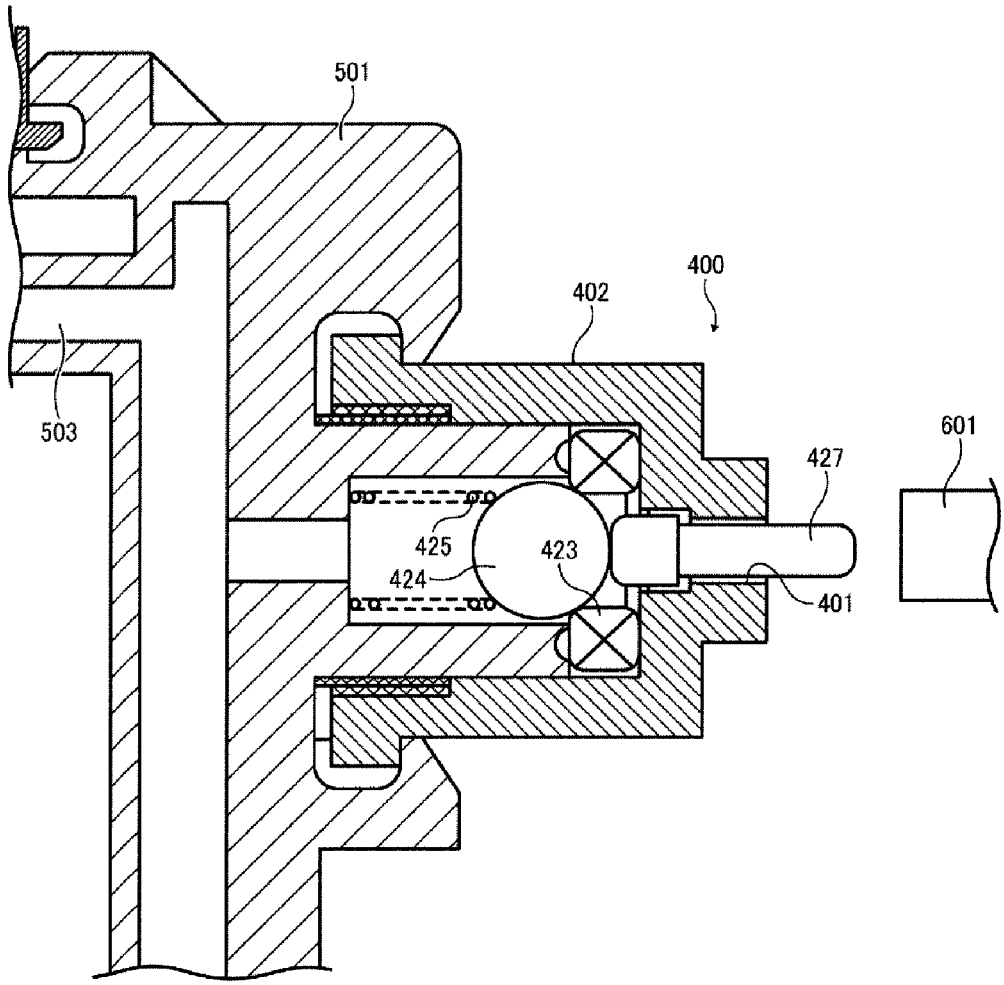
FIG. 1 RELATED ART
FIG. 1 is a vertical cross-sectional view illustrating a configuration of a related-art pressure release mechanism.

In describing illustrative embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Figure 2:
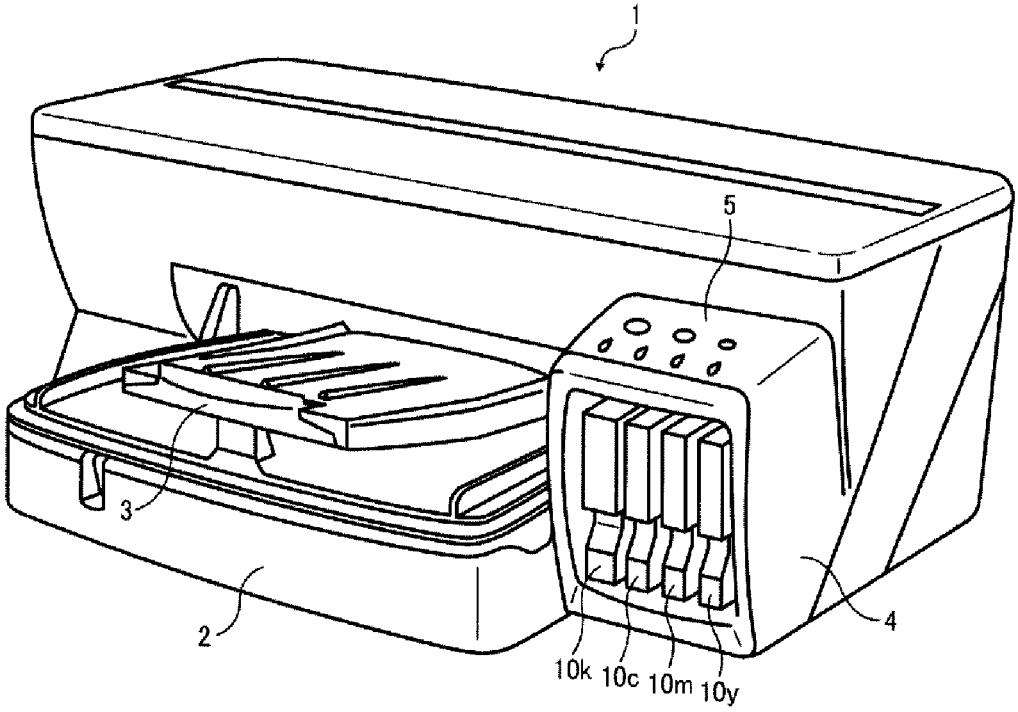
FIG. 2 is a perspective view illustrating an image forming apparatus according to illustrative embodiments.
Figure 3:
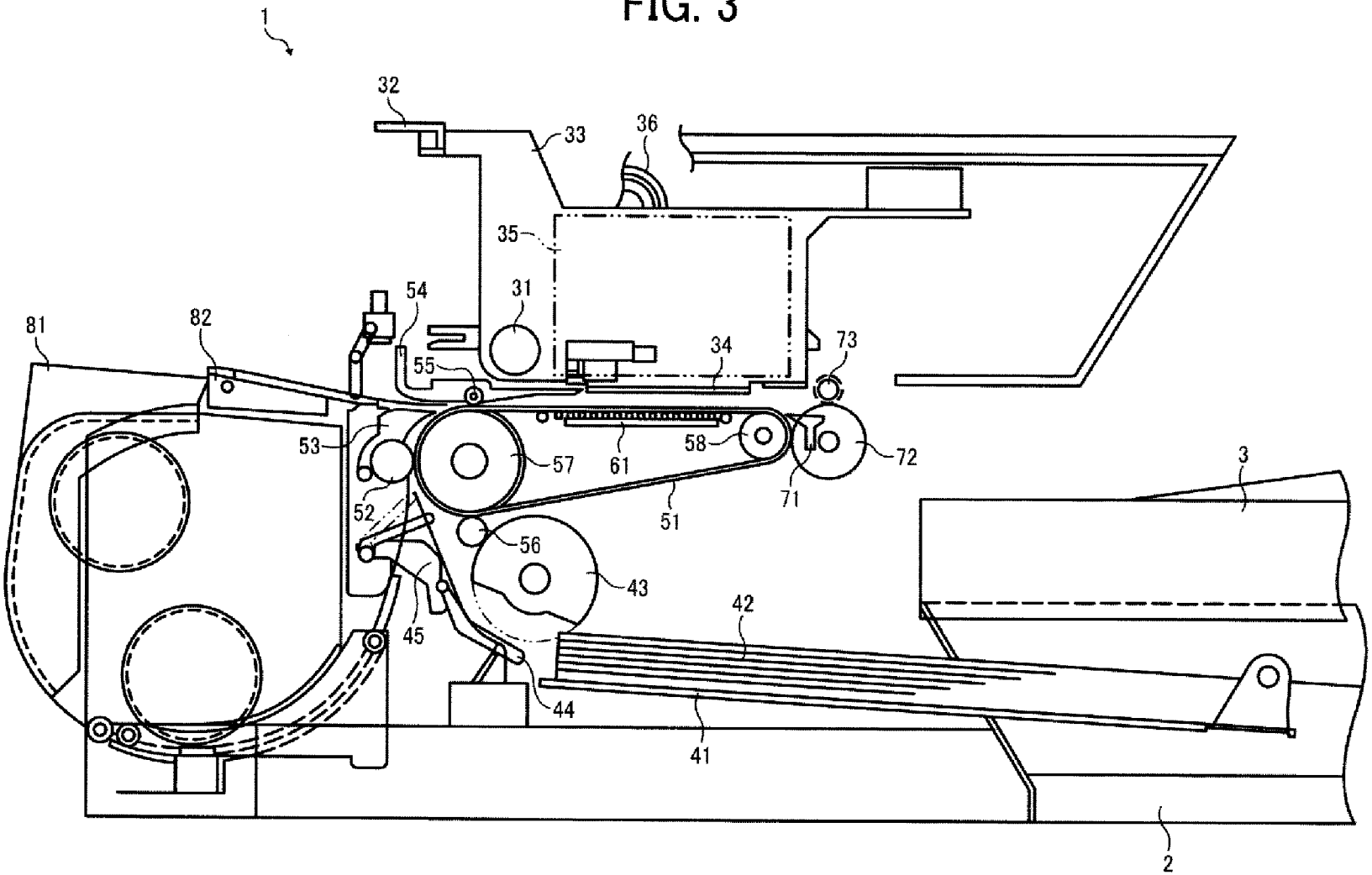
FIG. 3 is a vertical cross-sectional view illustrating an overall configuration of the image forming apparatus illustrated in FIG. 2.
Figure 4:
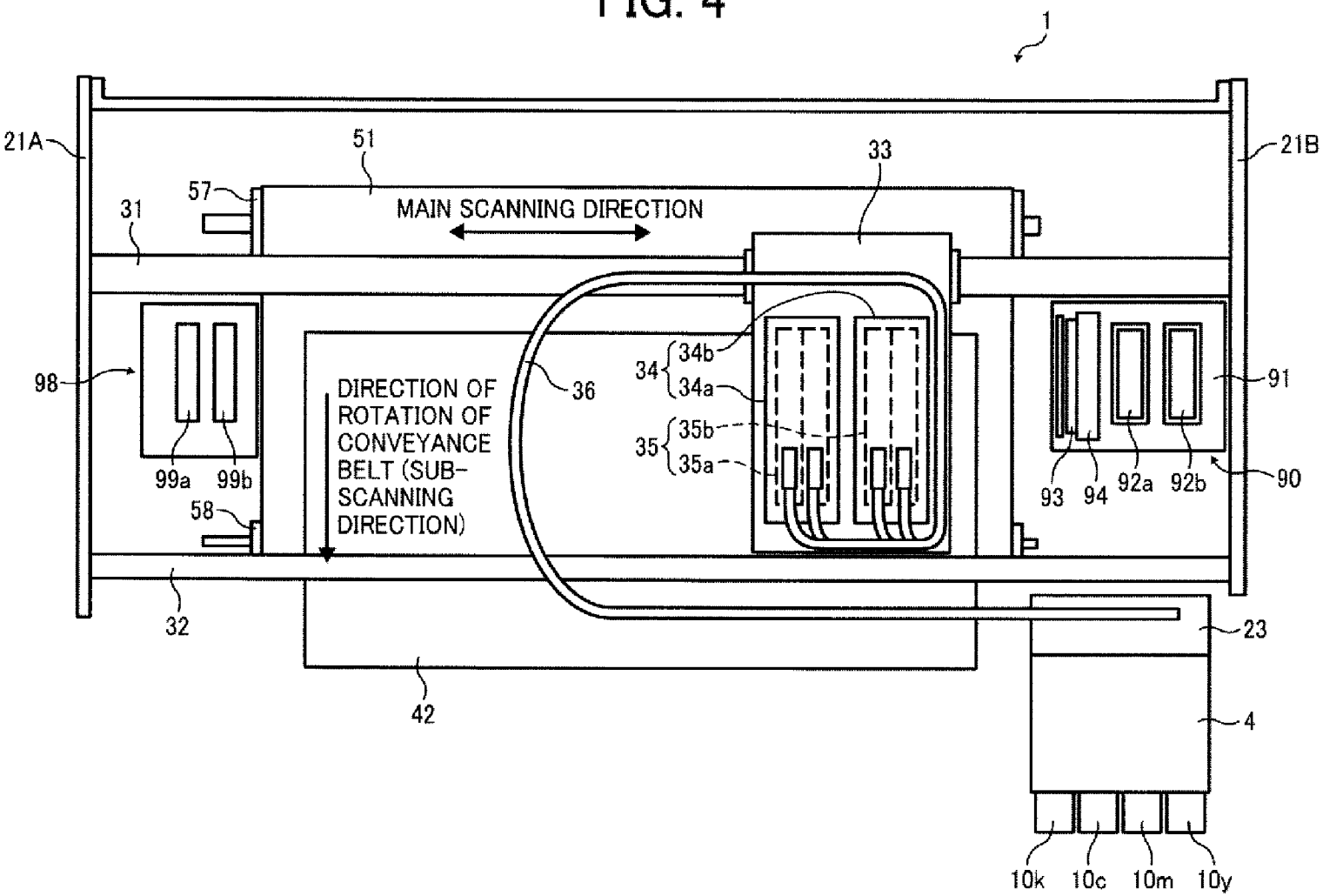
FIG. 4 is a top view illustrating a configuration of main components of the image forming apparatus illustrated in FIG. 2.

A description is now given of a configuration of an image forming apparatus 1 according to illustrative embodiments with reference to FIGS. 2 to 4. FIG. 2 is a perspective view illustrating the image forming apparatus 1 viewed from the front. FIG. 3 is a vertical cross-sectional view illustrating an overall configuration of the image forming apparatus 1. FIG. 4 is a top view illustrating a configuration of main components of the image forming apparatus 1.

The image forming apparatus 1 includes a main body, a sheet feed tray 2 attached to the main body to store recording media such as sheets of paper or the like to be fed to the image forming apparatus 1, and a discharge tray 3 attached to the main body to store the sheets, on which images are formed, discharged from the image forming apparatus 1. A cartridge mount 4 protruding forward from a front surface of the image forming apparatus 1 and having a height lower than a top surface of the image forming apparatus 1 is provided at one end of the front surface of the image forming apparatus 1. The cartridge mount 4 includes an operation unit 5 having operation keys, a display, and so forth, on a top surface thereof.

Ink cartridges 10*k*, 10*c*, 10*m*, and 10*y* (hereinafter collectively referred to as ink cartridges 10) each serving as a main tank are inserted into the cartridge mount 4 from a front surface side to a back surface side of the image forming apparatus 1 so that the ink cartridges 10 are attached to the cartridge mount 4. The ink cartridges 10 store a recording liquid such as ink of a specific color, that is, black (K), cyan (C), magenta (M), or yellow (Y). A front cover, not shown, openably closable when the ink cartridges 10 are detachably attached to the cartridge mount 4, is provided on a front surface of the cartridge mount 4.

As shown in FIG. 4, guide rods 31 and 32 each serving as a guide member are extended between right and left lateral end plates 21A and 21B, each of which forms part of a frame of the image forming apparatus 1 to slidably hold a carriage 33 in a main scanning direction indicated by double-headed arrow in FIG. 4. The carriage 33 is scanned in the main scanning direction by a main scanning motor, not shown. The carriage 33 includes a recording head 34*a* having multiple nozzle arrays each discharging ink droplets of a specific color, that is, black (K) or cyan (C), and a recording head 34*b* having multiple nozzle arrays each discharging ink droplets of a specific color, that is, magenta (M) or yellow (Y). The multiple nozzle arrays of each of the recording heads 34*a* and 34*b* (hereinafter collectively referred to as recording heads 34) are arranged perpendicular to the main scanning direction of the carriage 33, and the recording heads 34 are provided such that the ink droplets are discharged downward. Each of the recording heads 34 may include an energy generator to discharge the ink droplets. The energy generator may be a piezoelectric actuator having a piezoelectric element, a thermal actuator using an electrothermal convertor such as a heat generating resistance body to use a phase change caused by film boiling of a liquid, a memory metal actuator using a metallic phase change caused by a temperature change, or an electrostatic actuator using an electrostatic force.

The carriage 33 further includes sub-tanks 35*a* and 35*b* (hereinafter collectively referred to as sub-tanks 35) each supplying ink of a corresponding color to the recording heads 34. Each of the sub-tanks 35 includes two ink containers, and the ink of a corresponding color is supplied from the ink cartridges 10 attached to the cartridge mount 4 through an ink supply tube 36 for each color. A pump 23 that conveys ink stored in the ink cartridges 10 is provided in the cartridge mount 4.

The image forming apparatus 1 further includes a sheet feed unit that feeds sheets 42 placed on a bottom plate 41 of the sheet feed tray 2. Specifically, the sheet feed unit includes a sheet feed roller 43 that separates the sheets 42 placed on the bottom plate 41 one by one to feed each separated sheet 42 to the main body of the image forming apparatus 1, and a separation pad 44 formed of a material having a large frictional factor. The separation pad 44 is provided opposite the sheet feed roller 43 and is pressed against the sheet feed roller 43.

The image forming apparatus 1 further includes a conveyance unit that conveys the sheet 42 fed from the sheet feed unit to a portion below the recording heads 34. Specifically, the conveyance unit includes a conveyance belt 51 that electrostatically attracts the sheet 42 to convey the sheet 42, a counter roller 52 that sandwiches, with the conveyance belt 51, the sheet 42 conveyed from the sheet feed unit through a guide 45 to convey the sheet 42, a conveyance guide 53 that changes a direction of conveyance of the sheet 42 conveyed vertically upward to 90 degrees so that the sheet 42 is guided on the conveyance belt 51, and a pressing roller 55 pressed against the conveyance belt 51 by a pressing member 54. Further, a charging roller 56 serving as a charger to charge a surface of the conveyance belt 51 is provided in the conveyance unit.

The conveyance belt 51 is seamless and is stretched between a conveyance roller 57 and a tension roller 58 to rotate in a direction of rotation of the conveyance belt 51. The charging roller 56 contacts a top surface of the conveyance belt 51 and is rotated by rotation of the conveyance belt 51. A pressure of 2.5 N is applied to each end of a shaft of the charging roller 56. A guide member 61 is provided corresponding to a print range of the recording heads 34 on a back surface of the conveyance belt 51. The guide member 61 protrudes further toward the recording heads 34 than a tangent line between the conveyance roller 57 and the tension roller 58, a summit of each of which supports the conveyance belt 51. Accordingly, the conveyance belt 51 is pushed upward and guided by an upper surface of the guide member 61 in the print range, achieving flatness with higher accuracy.

The image forming apparatus 1 further includes a discharge unit that discharges the sheet 42 having an image formed thereon by the recording heads 34. Specifically, the discharge unit includes a separation pick 71 that separates the sheet 42 from the conveyance belt 51, and discharge rollers 72 and 73. The discharge tray 3 is provided substantially below the discharge roller 72. A height that is sufficient for accommodating a large number of the sheets 42 discharged to the discharge tray 3 is provided between the discharge rollers 72 and 73 and the discharge tray 3.

A duplex unit 81 is detachably attached to the back surface of the image forming apparatus 1. The sheet 42 conveyed to the duplex unit 81 by reverse rotation of the conveyance belt 51 is reversed by the duplex unit 81 and is conveyed between the counter roller 52 and the conveyance belt 51 again. A manual sheet feeder 82 is provided on a top surface of the duplex unit 81.

A maintenance/recovery device 90 that maintains nozzles of the recording heads 34 is provided in a non-print range at one edge of the image forming apparatus 1 in the main scanning direction. The maintenance/recovery device 90 includes a recovery unit 91 having two suction caps 92*a* and 92*b* (hereinafter collectively referred to as suction caps 92) each covering a nozzle surface of the recording head 34, a wiper blade 93 serving as a blade member for wiping the nozzle surface of the recording head 34, an ink collector 94 that receives ink droplets not used for image formation discharged from the recording heads 34 in order to remove high-viscosity ink, and so forth.

An ink collector 98 that receives ink droplets not used for image formation discharged from the recording heads 34 during image formation in order to remove high-viscosity ink is provided in the non-print range at the other edge of the image forming apparatus 1 in the main scanning direction. The ink collector 98 includes openings 99*a* and 99*b* each provided along the nozzle arrays of the recording heads 34.

In the image forming apparatus 1 having the above-described configuration, the sheets 42 separated and fed one by one vertically upward from the sheet feed tray 2 are guided by the guide 45 to the position between the conveyance belt 51 and the counter roller 52. The sheet 42 sandwiched between the conveyance belt 51 and the counter roller 52 is further conveyed, and a leading edge of the sheet 42 is guided by the conveyance guide 53. The sheet 42 is then pressed against the conveyance belt 51 by the pressing roller 55 so that the direction of conveyance of the sheet 42 is changed to 90 degrees. At this time, positive and negative voltages are applied alternately to the charging roller 56, that is, an alternating voltage is applied to the charging roller 56 from a high-voltage power supply through a control circuit, not shown, so that the conveyance belt 51 is charged in a pattern of an alternate charging voltages, that is, the conveyance belt 51 is alternately charged by positive and negative voltages with a predetermined width, in the direction of rotation of the conveyance belt 51 or a sub-scanning direction. Accordingly, the sheet 42 conveyed to the conveyance belt 51 thus alternately charged with the positive and negative voltages is electrostatically attracted to the conveyance belt 51 and is further conveyed in the sub-scanning direction by rotation of the conveyance belt 51. The recording heads 34 are driven according to an image signal while the carriage 33 is moved in the main scanning direction to discharge ink droplets for an image onto the sheet 42, the conveyance of which is temporarily stopped, one line at a time. Thereafter, the sheet 42 is conveyed for a certain distance, and ink droplets for the next line of the image are discharged to the sheet 42. Image formation is completed when a signal indicating completion of image formation or arrival of a rear edge of the sheet 42 at the print range is received, and the sheet 42 having the image thereon is discharged to the discharge tray 3.

In a stand-by mode, the carriage 33 is moved to the edge of the image forming apparatus 1 where the maintenance/recovery device 90 is positioned, and the recording heads 34 are covered with the suction caps 92, respectively. As a result, the nozzles of the recording heads 34 are kept moisturized, preventing irregular ink discharge caused by drying of the ink. In addition, the ink is sucked from the nozzles while the recording heads 34 are covered with the suction caps 92 so that highly viscose ink and bubbles in the ink can be removed. Further, the ink droplets not used for image formation are discharged from the recording heads 34 to the ink collector 98 before or during image formation. Accordingly, the recording heads 34 can constantly achieve superior discharge of the ink droplets.

Figure 5:
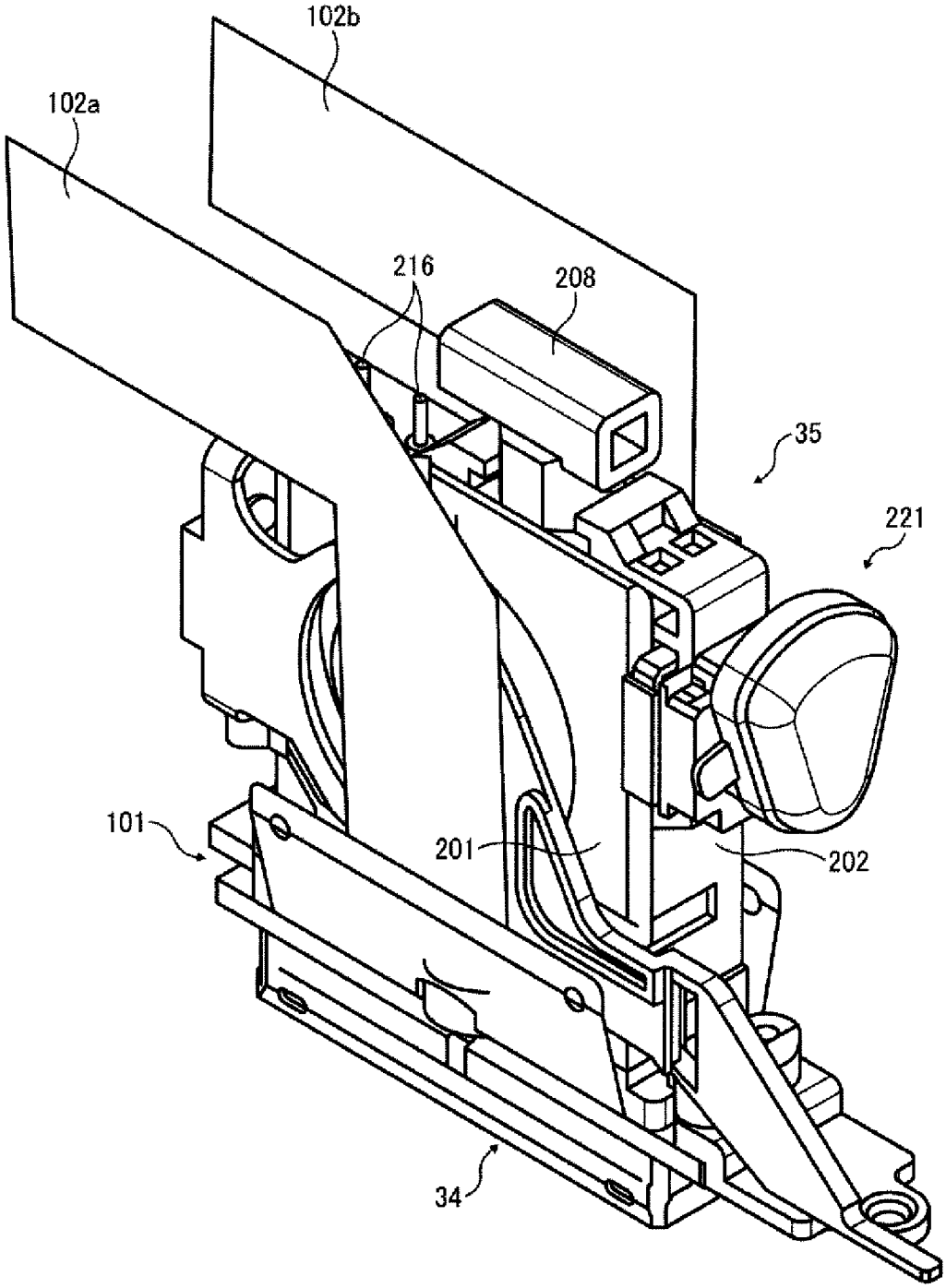
FIG. 5 is a perspective view illustrating a configuration of a recording head and a sub-tank both formed as a single integrated unit as a head according to a first illustrative embodiment.
Figure 6:
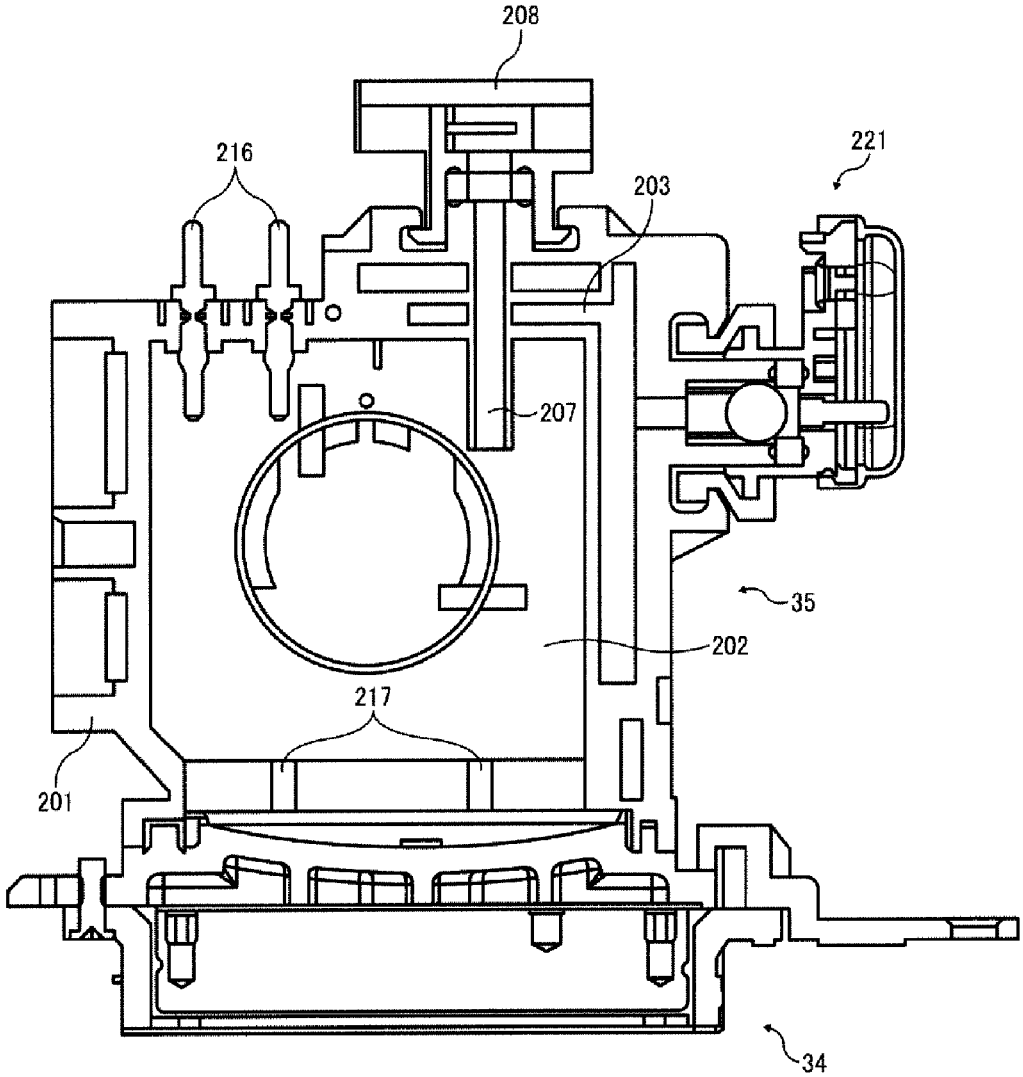
FIG. 6 is a vertical cross-sectional view illustrating a configuration of the head illustrated in FIG. 5.
Figure 7:
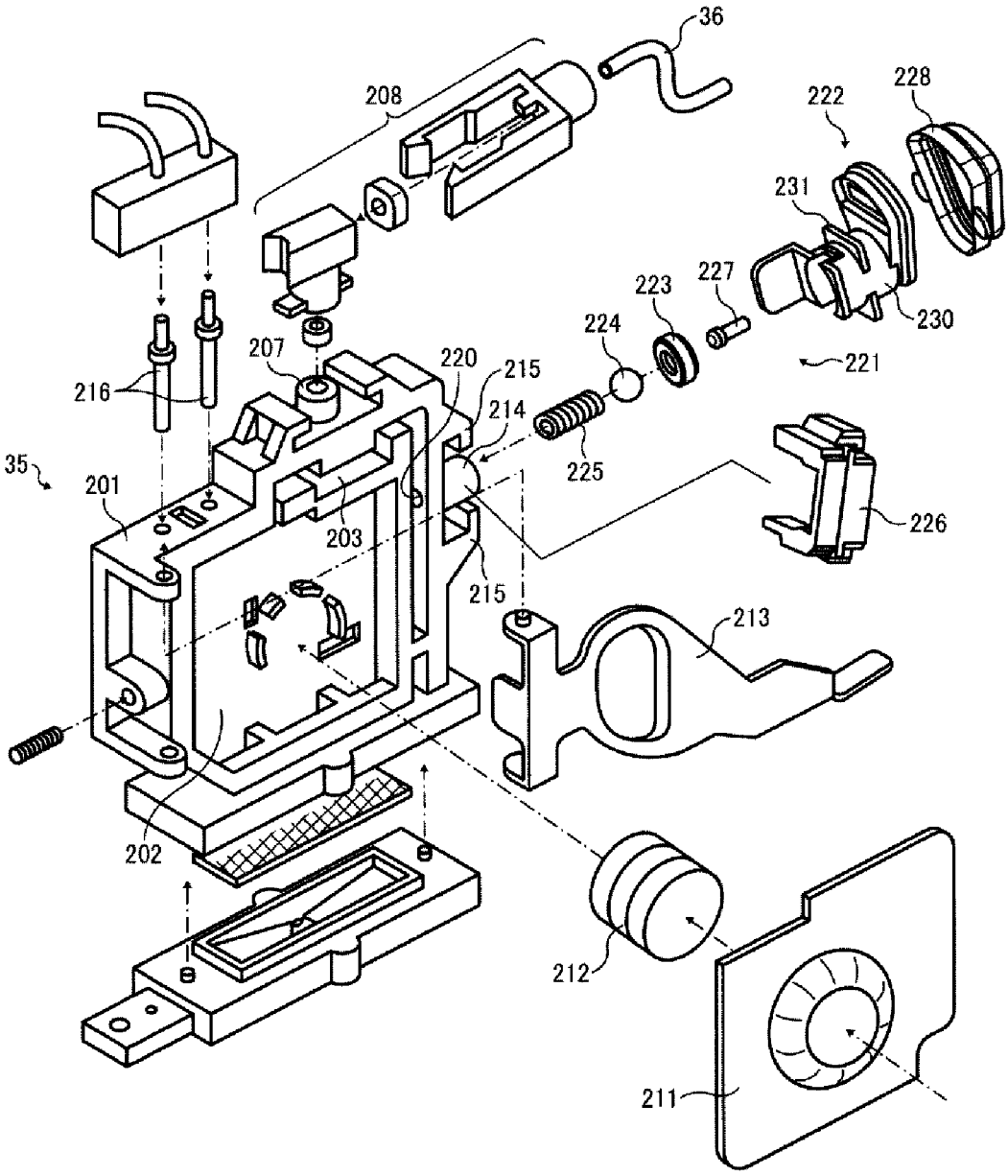
FIG. 7 is a perspective exploded view illustrating a configuration of the sub-tank illustrated in FIG. 5.

FIGS. 5 to 7 are views respectively illustrating a configuration of the recording head 34 and the sub-tank 35, in which both are formed as a single integrated unit as a head according to a first illustrative embodiment. Specifically, FIG. 5 is a perspective view illustrating a configuration of the head. FIG. 6 is a vertical cross-sectional view illustrating the configuration of the head. FIG. 7 is a perspective exploded view illustrating a configuration of the sub-tank 35.

The head is formed by the recording head 34, the sub-tank 35 that supplies ink of two different colors to the two nozzle arrays of the recording head 34, and a filter unit 101 provided between the sub-tank 35 and the recording head 34. Flexible cables 102*a* and 102*b* (hereinafter collectively referred to as flexible cables 102), each transmitting a signal for driving the actuator, are connected to the recording head 34.

The sub-tank 35 includes a container body 201 having an ink container 202 therein. A flexible film 211 is bonded to an opening on a lateral surface of the ink container 202 by bonding, welding, or the like, to seal the opening. An elastic member 212 that pushes the flexible film 211 outward is provided within the ink container 202 between and the flexible film 211 the other lateral surface of the ink container 202. A negative pressure generator is formed by the flexible film 211 and the elastic member 212. In the container body 201, a negative pressure detection lever 213 that displaces with displacement of the flexible film 211 is slidably provided. It is to be noted that although the ink container 202 is provided only on one side of the sub-tank 35 in FIGS. 5 to 7, alternatively, it may be provided on both sides of the sub-tank 35.

A release path 203 that releases pressure from the ink container 202 is provided at an upper portion of the container body 201, and a pressure release mechanism 221 is provided to open and close the release path 203. The container body 201 includes an ink supply opening 207 through which ink is supplied to the ink container 202, and the ink supply tube 36 is connected to the ink supply opening 207 through a connection assembly 208. Further, two detection electrodes 216 each detecting ink stored in the ink container 202 are provided at the upper portion of the container body 201. Supply openings 217 that individually supply the ink to the filter unit 101 from the ink container 202 is provided at a bottom surface of the container body 201.

Figure 8A:
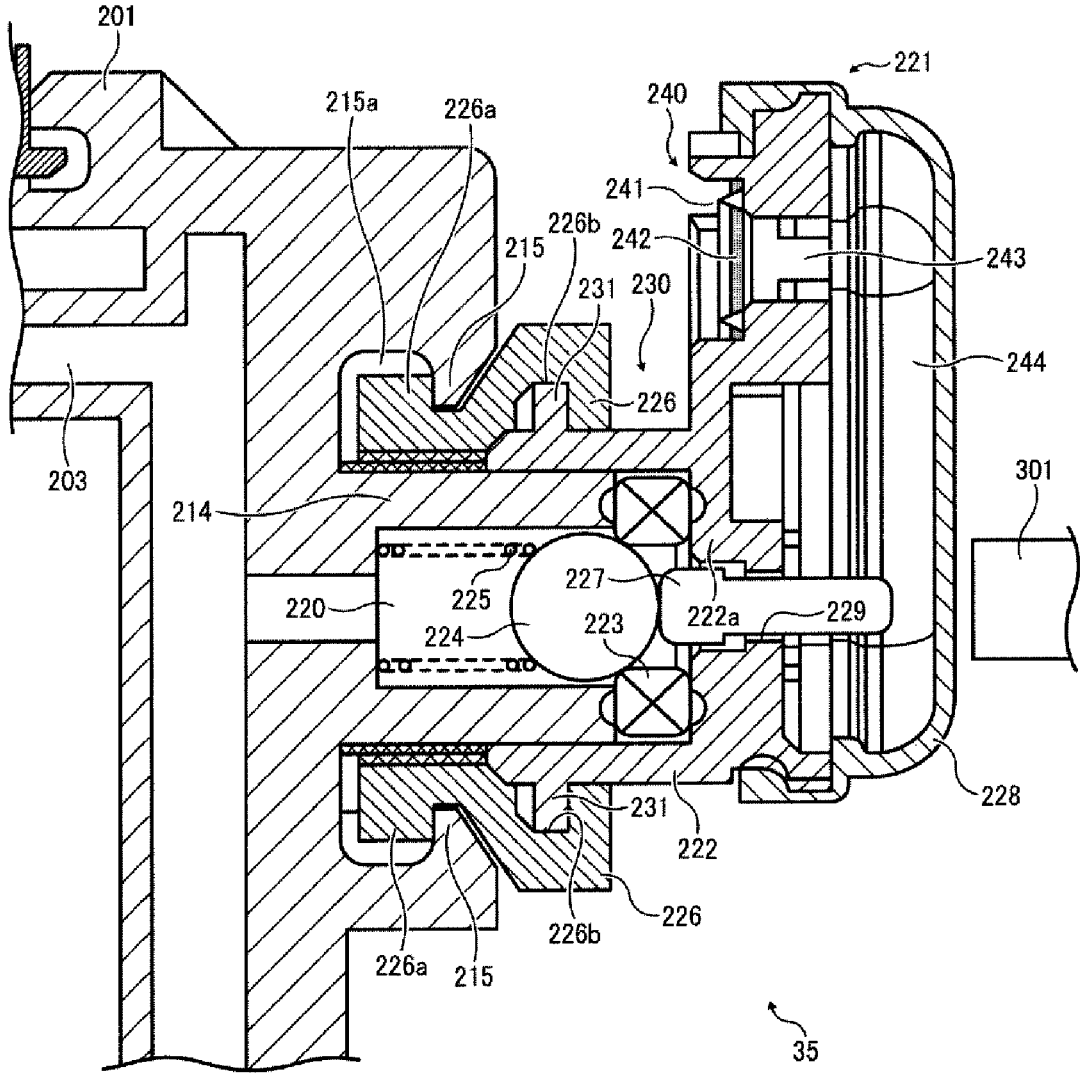
FIG. 8A is a vertical cross-sectional view illustrating a configuration of a pressure release mechanism according to the first illustrative embodiment.
Figure 8B:
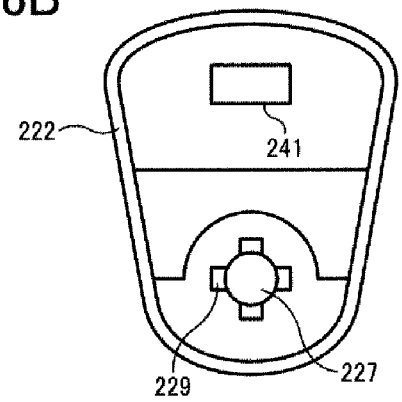
FIG. 8B is a side view illustrating a configuration of a holder included in the pressure release mechanism illustrated in FIG. 8A.
Figure 9A:
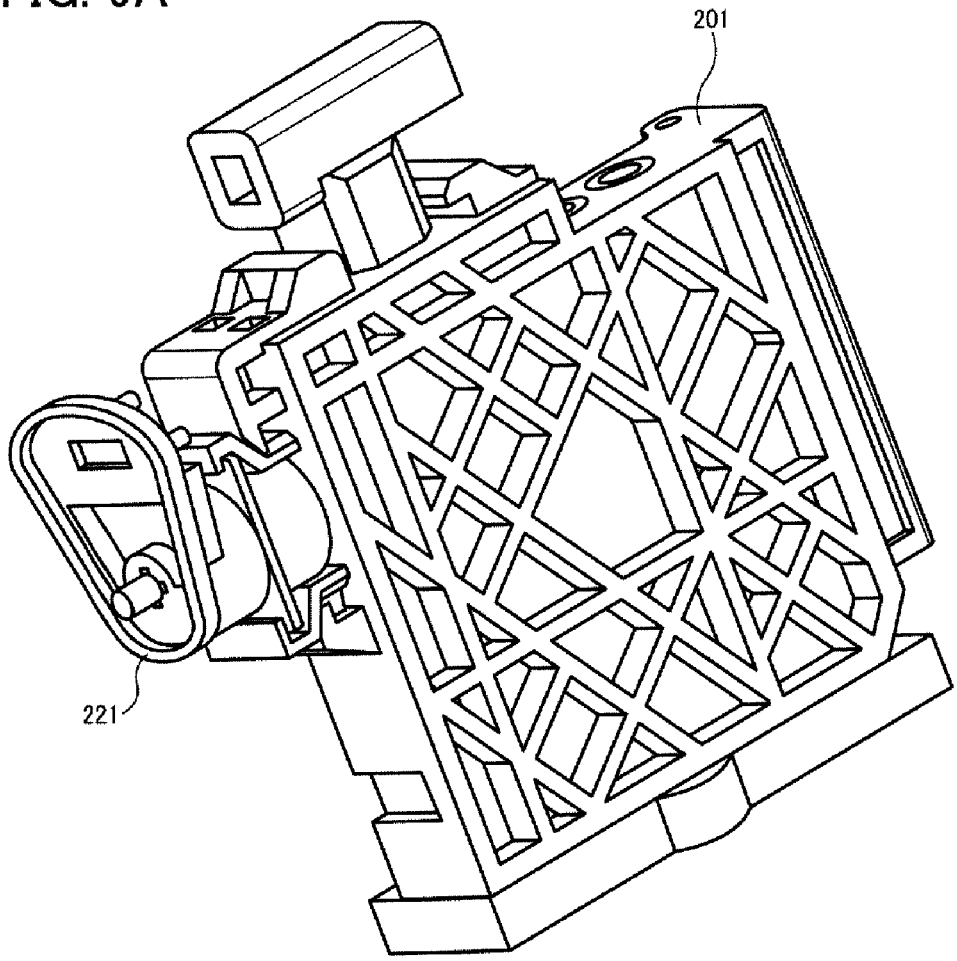
FIGS. 9A and 9B are perspective views respectively illustrating the configuration of the pressure release mechanism according to the first illustrative embodiment.
Figure 9B:
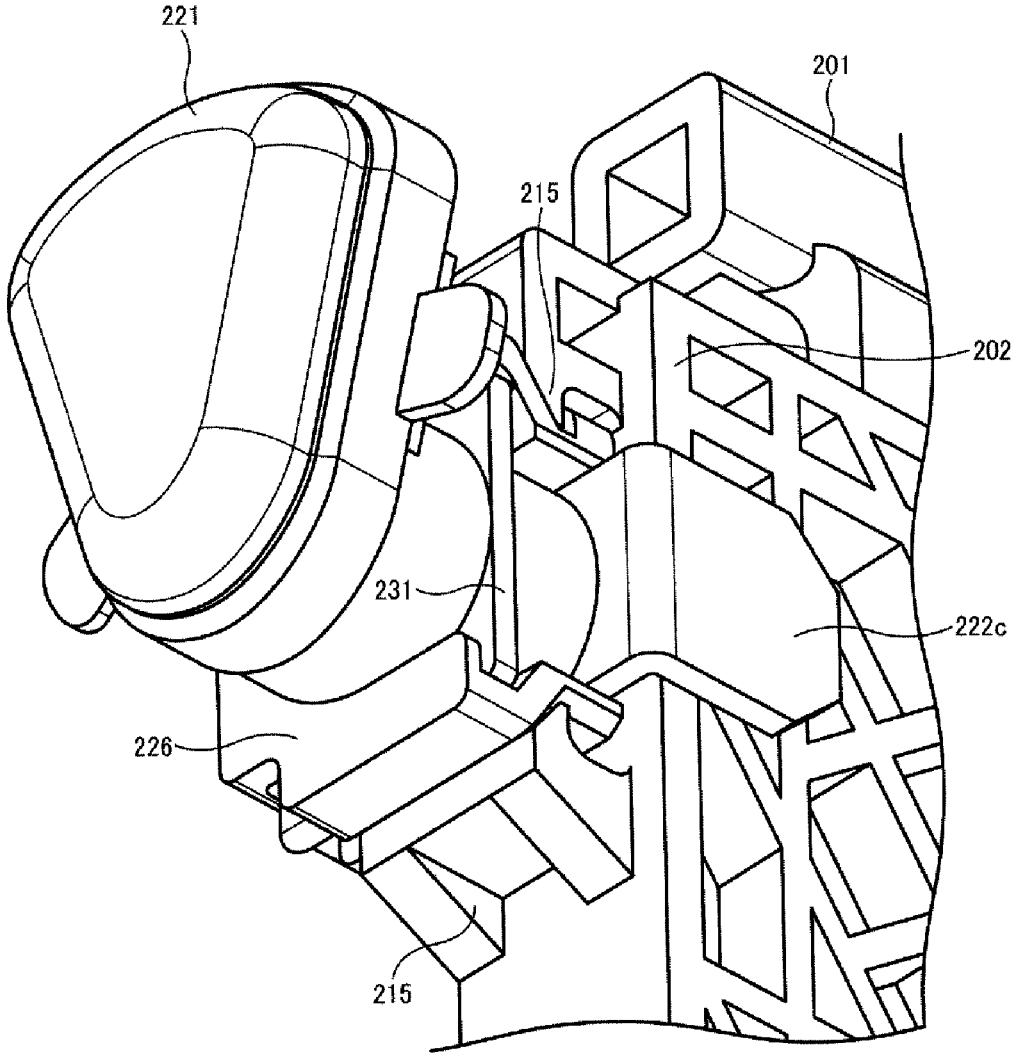
Figure 10:
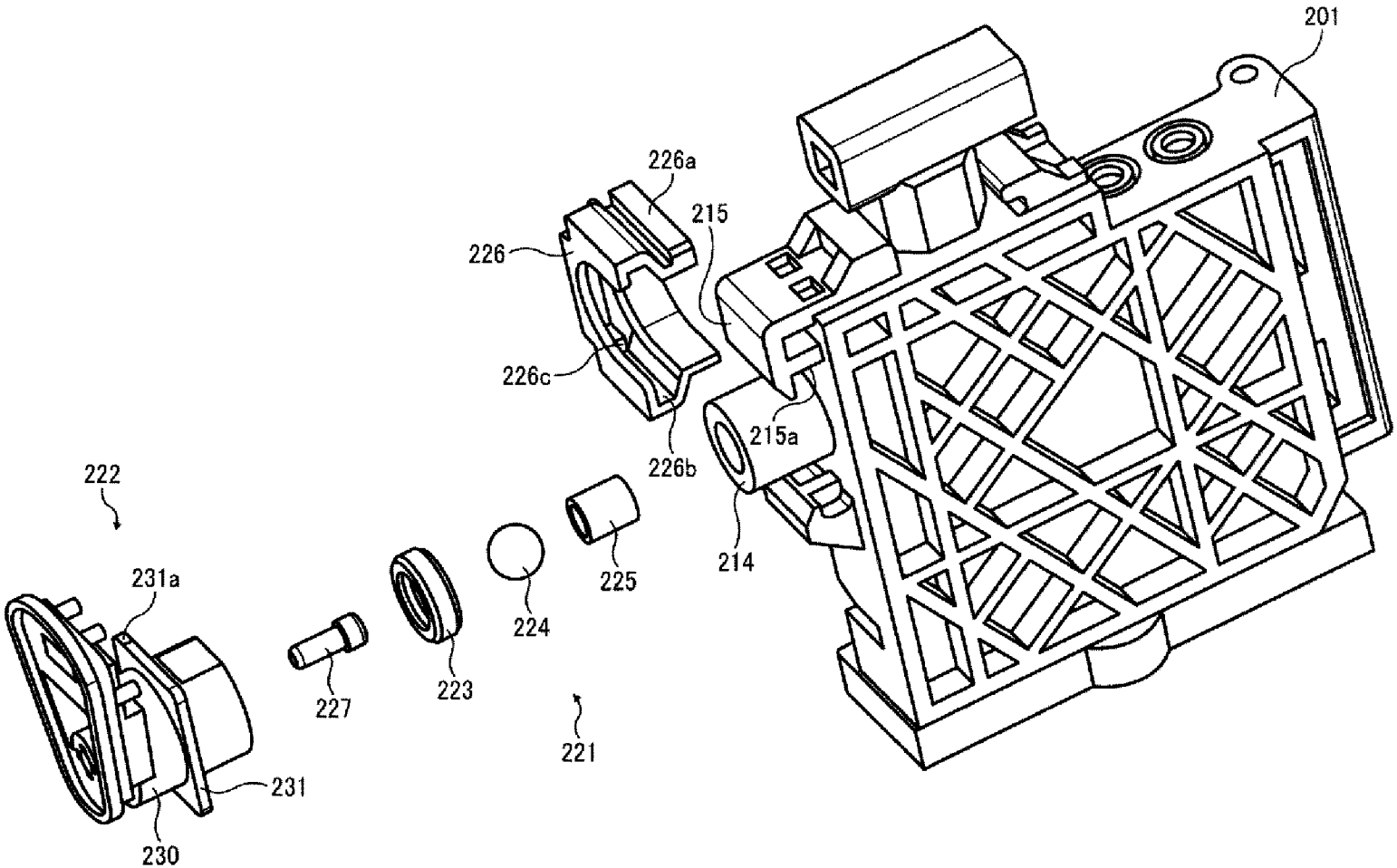
FIG. 10 is a perspective exploded view illustrating the configuration of the pressure release mechanism according to the first illustrative embodiment.
Figure 11:
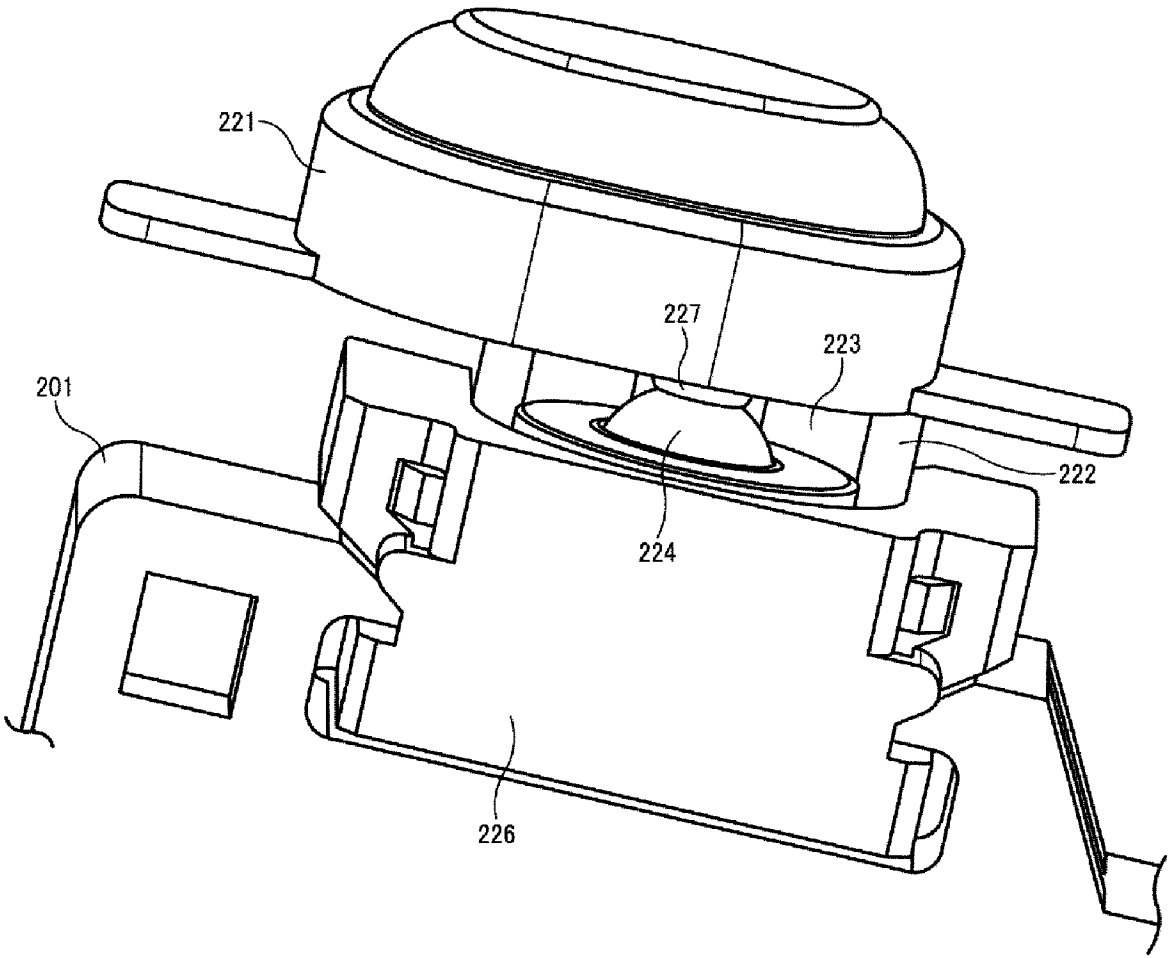
FIG. 11 is a perspective view illustrating an appearance of the pressure release mechanism according to the first illustrative embodiment.

A detailed description is now given of a configuration of the pressure release mechanism 221 of the sub-tank 35. FIG. 8A is a vertical cross-sectional view illustrating the configuration of the pressure release mechanism 221. FIG. 8B is a side view illustrating a configuration of a holder 222 provided to the pressure release mechanism 221. FIGS. 9A and 9B are perspective views respectively illustrating the configuration of the pressure release mechanism 221. FIG. 10 is a perspective exploded view illustrating the configuration of the pressure release mechanism 221.

A holder mounting part 214 of the container body 201 having a hollow protruding cylinder is provided at the upper portion of the container body 201 to attach the pressure release mechanism 221 to the container body 201. The holder mounting part 214 leads to the release path 203 of the container body 201 to form a pressure release path 220 communicating between the interior and the exterior of the container body 201.

The pressure release mechanism 221 includes the holder 222 formed of a transparent resin, a valve seat 223 having a cylindrical gasket formed of a transparent elastomeric material or rubber material, a ball 224 serving as a valve, a coil spring 225 serving as an elastic member, a fixing member 226, a biasing pin 227, and a deformable elastic cap 228. The holder 222 includes a cylindrical attaching member 230 to be attached to the holder mounting part 214 of the container body 201, and a pressure communicating part 240 provided at a position in a direction perpendicular to a shaft center of the cylindrical attaching member 230, that is, an upward direction from the shaft center of the cylindrical attaching member 230. As illustrated in FIG. 8B, a valve seat holding member 222*a* having a cross-shaped pressure path 229 is provided on a wall surface of the cylindrical attaching member 230 opposite a wall surface thereof facing the holder mounting part 214. Specifically, a part of an outer circumferential surface of the holder 222 that connects the pressure release path 220 of the holder mounting part 214 and the exterior is cut out to form the pressure path 229, and the biasing pin 227 is inserted into the pressure path 229. The valve seat 223 is inserted into the cylindrical attaching member 230 of the holder 222. When the holder 222 is attached to the holder mounting part 214 of the container body 201, the valve seat 223 is held between the valve seat holding member 222*a* forming the pressure path 229 of the cylindrical attaching member 230 and an outer edge surface of the holder mounting part 214. The ball 224 is pressed against the valve seat 223 by the coil spring 225 to form a valve mechanism that forms a seal between the pressure release path 220 of the holder mounting part 214 and the pressure path 229 of the holder 222. It is preferable that a seal surface of the ball 224 contacting the valve seat 223 have a convex semi-spherical shape, and a boss into which the coil spring 225 is fitted be provided on a surface opposite the seal surface of the ball 224.

A protrusion 231 is provided at a portion on an outer circumferential surface of the cylindrical attaching member 230 of the holder 222 in a vertical direction. Two hooks 215 are respectively provided at both sides of the holder mounting part 214 in the vertical direction to sandwich the holder mounting part 214 of the container body 201. The fixing member 226 has two U-shaped protrusions 226*a* respectively engaging the hooks 215 of the container body 201 on an outer edge surface thereof, and an engaging groove 226*b* on an inner surface thereof so that the protrusion 231 of the holder 222 is fitted into the engaging groove 226*b* of the fixing member 226.

When the holder 222 is attached to the holder mounting part 214 of the container body 201, the cylindrical attaching member 230 of the holder 222 in which the valve seat 223, the ball 224, and the biasing pin 227 are provided is inserted into the holder mounting part 214 of the container body 201. When the fixing member 226 is inserted into the holder 222 and the container body 201 from a horizontal direction from a U-shaped opening of the fixing member 226 while the holder 222 is attached to the holder mounting part 214 of the container body 201 as illustrated in FIG. 10, the engaging groove 226*b* of the fixing member 226 engages the protrusion 231 of the holder 222, and the protrusion 226*a* of the fixing member 226 is inserted into a groove 215*a* formed by the hook 215 of the container body 201 and a wall surface of the container body 201. As a result, the holder 222 is fixed to the container body 201.

As described above, the fixing member 226 is inserted into the holder 222 and the container body 201 from a horizontal direction to fix the holder 222 to the holder mounting part 214 of the container body 201. A direction of insertion of the fixing member 226 is perpendicular to a direction of arrangement of the hooks 215 in the container body 201, that is, a vertical direction. Accordingly, when the fixing member 226 is inserted into the holder 222 and the container body 201, the hooks 215 do not prevent insertion of the fixing member 226 into the holder 222 and the container body 201. As a result, the holder 222 is fixed to the holder mounting part 214 without rotating the holder 222, so that deformation of the valve seat 223 provided within the holder 222 can be prevented, thereby reliably providing stable contact between the valve seat 223 and the ball 224.

If the holder 222 attached to the holder mounting part 214 is rotated before the fixing member 226 is inserted into the holder 222 and the container body 201, the valve seat 223 provided within the holder 222 may be twisted, and consequently, it may be difficult to insert the fixing member 226 into the holder 222. To prevent such a problem, a contact surface 222*c* which contacts a lateral surface of the container body 201 is provided to the holder 222. Accordingly, the holder 222 is guided by the contact surface 222*c* to be attached to the holder mounting part 214 without rotating. Means for preventing rotation of the holder 222 is not particular limited to the contact surface 222*c*, and alternatively, for example, a combination of a pin provided to the container body 201 and a hole provided to the holder 222 may be used.

The holder 222 is formed of a transparent resin material such as a PC resin, a transparent ABS resin, and an AS resin, and is provided at a position such that a portion where the valve seat 223 and the ball 224 contact each other can be visually confirmed. Further, a position into which the fixing member 226 is inserted does not cover the portion where the valve seat 223 and the ball 224 contact each other. Accordingly, when the holder 222 is attached to the holder mounting part 214 to be fixed to the container body 201, the portion where the valve seat 223 and the ball 224 contact each other can be visually confirmed through the holder 222, thereby facilitating detection of deformation of the valve seat 223 as well as the presence of foreign substances sandwiched between the valve seat 223 and the ball 224. Further, the valve seat 223 is formed of a transparent elastomeric material or rubber material so that the contact surface between the ball 224 and the valve seat 223 can be easily confirmed from outside, enhancing stability of the valve mechanism.

In order to prevent detachment of the fixing member 226 after the fixing member 226 is inserted into the holder 222 and the container body 201 from the horizontal direction, a concavity 231*a* is provided at a portion of the protrusion 231 on both sides of the cylindrical attaching member 230 of the holder 222, and protrusions 226*c* are provided to the fixing member 226 at positions corresponding to the concavities 231*a*. Accordingly, when the fixing member 226 is inserted into the holder 222 and the container body 201 from the horizontal direction, the concavities 231*a* of the protrusion 231 engage the protrusions 226*c* of the fixing member 226, respectively, to prevent detachment of the fixing member 226 from the holder 222.

The valve mechanism including the valve seat 223, the ball 224, and the coil spring 225 each provided within the holder 222 fixed to the container body 201 is opened when the ball 224 is separated from the valve seat 223 by pressing the biasing pin 227 using an external pressing member 301. When pressure from the external pressing member 301 on the biasing pin 227 is released, the ball 224 is pressed against the valve seat 223 by an elastic force from the coil spring 225 to close the valve mechanism to connect the pressure release path 220 of the holder mounting part 214 and the pressure path 229 of the holder 222 to each other.

A filter member 242, an external surface of which contacts air, is provided at a pressure opening 241 provided to a surface of the pressure communicating part 240 facing the container body 201, that is, a surface of the pressure communicating part 240 facing the cylindrical attaching member 230. As described above, the pressure communicating part 240 is provided at the position in the direction perpendicular to the direction of the shaft center of the cylindrical attaching member 230 having the valve mechanism of the holder 222, that is, the upward direction from the shaft center of the cylindrical attaching member 230. Further, an air chamber 243 having a cross-section larger than the pressure path 229 of the cylindrical attaching member 230 in a direction perpendicular to a direction of inflow of air is provided on an inner surface of the filter member 242. Moreover, an air communicating path 244 which has a space for storing air and is larger than the air chamber 243 is formed by the holder 222 and the deformable elastic cap 228 between the air chamber 243 on the inner surface of the filter member 242 and the pressure path 229.

For the filter member 242, for example, a metal filter mesh, a compressed sintered filter having metal fibers, an electroforming metal filter, a foam filter having a porous structure, and so forth, may be used. Alternatively, a filter having a capillarity effect through which air can be passed but a liquid cannot be passed under a predetermined amount of pressure may be used as the filter member 242.

As described above, the air chamber 243 is provided on the inner surface of the filter member 242 provided at the pressure opening 241 on the surface of the pressure communicating part 240 facing the container body 201 or the cylindrical attaching member 230. The pressure communicating part 240 is provided at the position in the direction perpendicular to the direction of the shaft center of the cylindrical attaching member 230 of the holder 222, that is, the upward direction from the shaft center of the cylindrical attaching member 230. Air introduced from outside is temporarily diffused in the air chamber 243, and then is introduced into the pressure path 229 through the air communicating path 244 having a space for storing air larger than the air chamber 243. Accordingly, foreign substances passing through the filter member 242 remain in the air chamber 243 and are prevented from entering further inside from the air communicating path 244 to the pressure path 229. As a result, a decrease in air-tightness of the valve mechanism due to the foreign substances sandwiched between the valve seat 223 and the ball 224 can be prevented. In other words, unnecessary introduction of air into the sub-tank 35 due to a decrease in air-tightness within the sub-tank 35 can be prevented, thereby reliably supplying ink.

Insertion of the fixing member 226 into the holder 222 and the container body 201 from the horizontal direction to fix the holder 222 to the container, body 201 with the fixing member 226 is described above. A description is now given of a case in which the fixing member 226 is rotated relative to the holder 222 to fix the holder 222 to the container body 201 with the fixing member 226.

Figure 12:
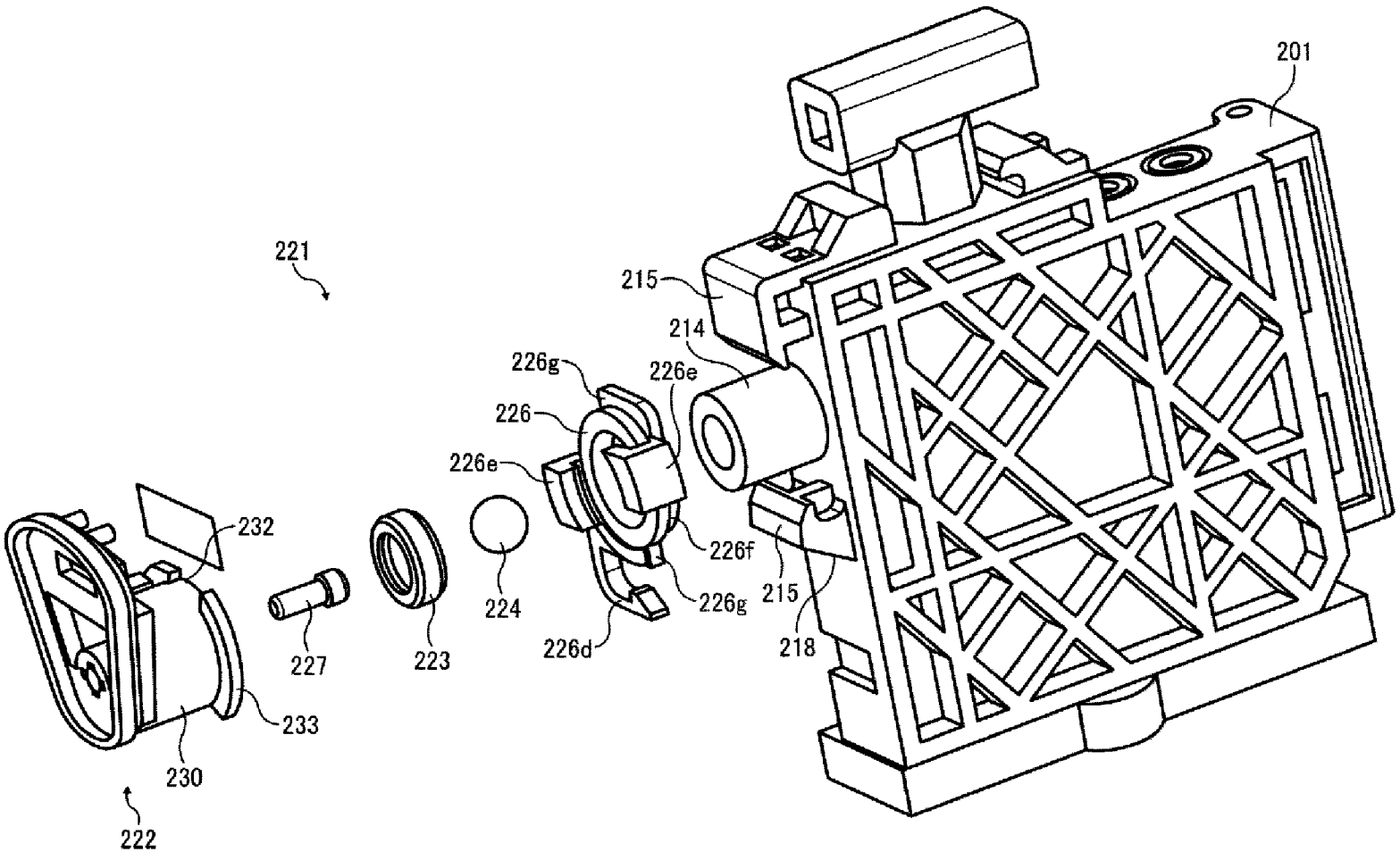
FIG. 12 is a perspective exploded view illustrating a configuration of a pressure release mechanism according to a second illustrative embodiment.

FIG. 12 is a perspective exploded view illustrating a configuration of the pressure release mechanism 221 according to a second illustrative embodiment. A protrusion 233 having two cutouts 232 therein positioned relative to each other is provided on a top external circumferential surface of the cylindrical attaching member 230 of the holder 222 on the container body 201 side. The fixing member 226 includes two protrusions 226*g* respectively engaging the two hooks 215 provided on the external surface of the container body 201 at the positions sandwiching the holder mounting part 214 of the container body 201. The fixing member 226 further includes an engaging hook 226*d* that extends from one edge of one of the protrusions 226*g* and which engages an engaging portion 218 provided opposite the hook 215 of the container body 201, and hooks 226*e* which are inserted into the cutouts 232 of the protrusion 233 of the holder 222 and rotated to be engaged with the protrusion 233 of the holder 222.

Figure 13A:
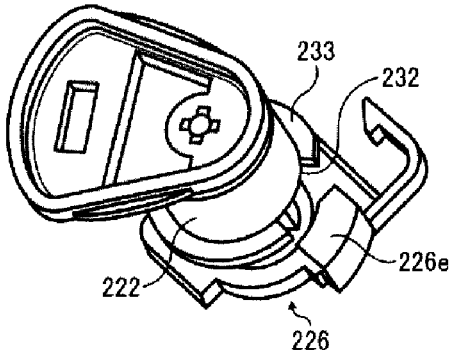
FIGS. 13A to 13F are views respectively illustrating mounting of the pressure release mechanism illustrated in FIG. 12 to the sub-tank.
Figure 13B:
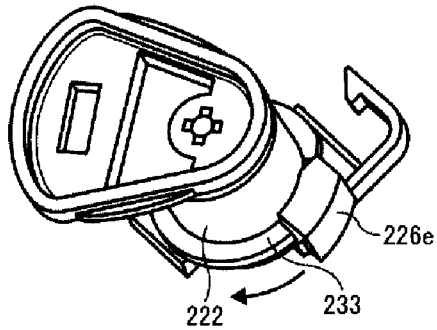
Figure 13C:
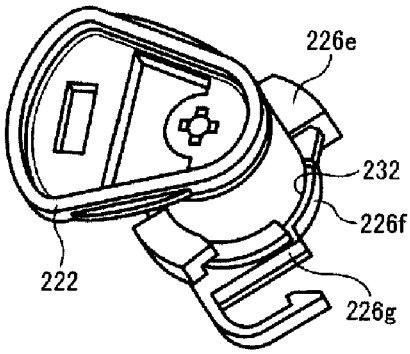
Figure 13D:
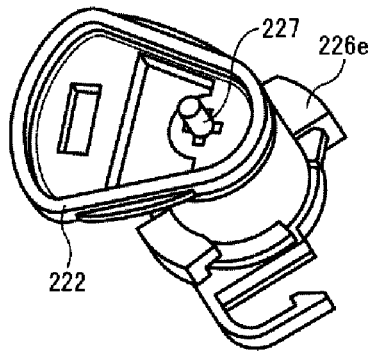
Figure 13E:
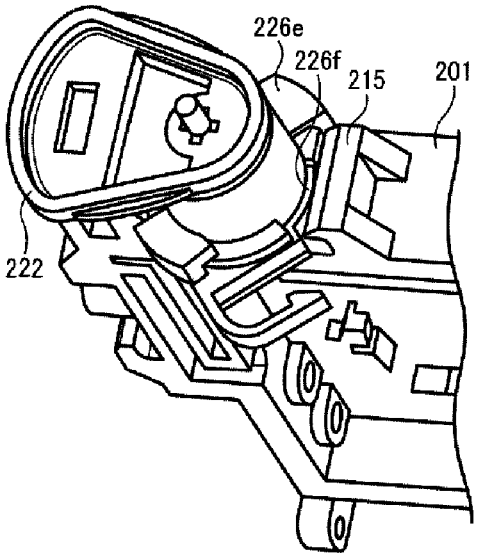
Figure 13F:
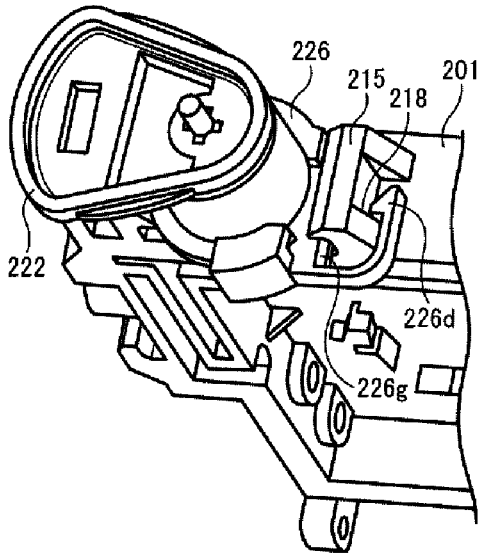

Mounting of the holder 222 to the container body 201 with the fixing member 226 illustrated in FIG. 12 is described in detail below with reference to FIGS. 13A to 13F. As illustrated in FIG. 13A, the hooks 226*e* of the fixing member 226 are inserted into the cutouts 232 of the protrusion 233 of the holder 222. Subsequently, either the holder 222 or the fixing member 226 is rotated to hook the hooks 226*e* of the fixing member 226 on the protrusion 233 of the holder 222 as illustrated in FIG. 13B. The cutout 232 of the protrusion 233 of the holder 222 is aligned with a cutout 226*f* provided between the protrusion 226*g* of the fixing member 226 and the hooks 226*e* so that the fixing member 226 is attached to the holder 222 as illustrated in FIG. 13C. In the state illustrated in FIG. 13C, the valve seat 223, the biasing pin 227, the ball 224, and the coil spring 225 are set within the holder 222 as illustrated in FIG. 13D. Then, the cutout 226*f* of the fixing member 226 is positioned between the two hooks 215 of the container body 201 to attach the holder 222 to the holder mounting part 214 of the container body 201 as illustrated in FIG. 13E. Thereafter, as illustrated in FIG. 13F, the fixing member 226 is rotated to engage the protrusions 226*g* of the fixing member 226 with the hooks 215 while the engaging hook 226*d* of the fixing member 226 is hooked on and engages the engaging portion 218 of the container body 201 to fix the fixing member 226 to the container body 201. A thickness of the fixing member 226 and a space between the hooks 215 of the container body 201 are sized to prevent looseness in a direction of a shaft of the cylinder of the holder 222 when the holder 222 is fixed to the container body 201. Thereafter, the deformable elastic cap 228 is attached to the holder 222 to seal the pressure path 229 and the pressure communicating part 240.

As described above, the holder 222 is fixed to the container body 201 without rotating the holder 222, thereby preventing twist and deformation of the valve seat 223 provided within the holder 222. Accordingly, stable contact between the valve seat 223 and the ball 224 can be reliably maintained.

Although the inkjet-type recording device is used as the image forming apparatus 1 in the foregoing illustrative embodiments, the foregoing illustrative embodiments are applicable to inkjet-type copiers, facsimiles, and so forth.

As can be appreciated by those skilled in the art, numerous additional modifications and variations are possible in light of the above teachings. It is therefore to be understood that within the scope of the appended claims, the disclosure of this patent specification may be practiced otherwise than as specifically described herein. For example, elements and/or features of different illustrative embodiments may be combined with each other and/or substituted for each other within the scope of this disclosure and appended claims.

This patent specification is based on Japanese Patent Application No. 2009-128566, filed on May 28, 2009 in the Japan Patent Office, which is hereby incorporated herein by reference in its entirety.

What is claimed is:

1. A liquid container comprising:

a container body to store a liquid;

a pressure release mechanism to open and close a pressure release path in the container body; and a fixing member, the container body comprising:

the pressure release path to connect a release path and the pressure release mechanism;

a cylindrical holder mounting part having the pressure release path therein to which the pressure release mechanism is attached;

multiple hooks provided at vertically opposed positions outside the cylindrical holder mounting part with the cylindrical holder mounting part interposed therebetween; and the release path formed within the container body to release pressure from the container body, the pressure release mechanism comprising:

a pressure communicating part to communicate with air through a filter member; and a holder attached to the cylindrical holder mounting part, the holder comprising a pressure path to connect the pressure release path and the pressure communicating part and a valve mechanism to open and close the pressure path, the valve mechanism comprising a cylindrical valve seat to contact a valve seat holding member, a valve to contact an inner diameter of the valve seat, an elastic member to press the valve against the valve seat, and a biasing pin inserted into the pressure path, an end of the biasing pin contacting the valve, the valve seat holding member having an opening through which the pressure path passes, the valve seat holding member provided on a wall surface of the holder opposite a wall surface thereof to be attached to the cylindrical holder mounting part, the fixing member fixing the holder to the cylindrical holder mounting part by being inserted into each of a mounting portion of the holder and a mounting portion of the cylindrical holder mounting part from a horizontal direction perpendicular to the positions of the hooks while the holder including the valve mechanism is inserted into the cylindrical holder mounting part.

2. The liquid container according to claim 1, wherein the holder is formed of a transparent resin and the fixing member is inserted into each of the holder and the cylindrical holder mounting part, a point of contact between the valve and the valve seat both included in the valve mechanism of the holder remaining exposed.

3. The liquid container according to claim 1, the holder further comprising:

a cylindrical attaching member including the valve mechanism therein; and the pressure communicating part provided at a position in a direction perpendicular to a center of a shaft of the cylindrical attaching member, the pressure communicating part comprising:

a pressure opening provided in the same direction as the cylindrical attaching member;

the filter member provided at the pressure opening; and an air chamber provided on an inner surface of the filter member, the air chamber having a cross-section larger than the pressure path in a direction perpendicular to a direction of inflow of air, wherein the pressure path and the pressure communicating part on the air chamber side are covered with a deformable elastic cap.

4. The liquid container according to claim 1, wherein the fixing member engages the holder from a direction perpendicular to a direction of a cylinder of the holder.

5. The liquid container according to claim 4, wherein the fixing member engages a portion between the multiple hooks of the container body while engaging the holder and the cylinder of the holder is rotated around the center thereof to engage the multiple hooks.

6. The liquid container according to claim 1, wherein the valve seat is formed of a permeable elastomeric material.

7. The liquid container according to claim 1, wherein the valve seat is formed of a rubber material.

8. The liquid container according to claim 1, wherein the valve has a shape of a ball.

9. The liquid container according to claim 1, wherein the holder further comprises a rotation preventer to engage a part of the container body to prevent rotation of the holder.

10. A liquid droplet discharging device to supply a liquid from a liquid container to a liquid droplet discharging head, the liquid droplet discharging device comprising:

the liquid container comprising:

a container body to store a liquid;

a pressure release mechanism to open and close a pressure release path in the container body; and a fixing member, the container body comprising:

the pressure release path to connect a release path and the pressure release mechanism;

a cylindrical holder mounting part having the pressure release path therein to which the pressure release mechanism is attached;

multiple hooks provided at vertically opposed positions outside the cylindrical holder mounting part with the cylindrical holder mounting part interposed therebetween; and the release path formed within the container body to release pressure from the container body, the pressure release mechanism comprising:

a pressure communicating part to communicate with air through a filter member; and a holder attached to the cylindrical holder mounting part, the holder comprising a pressure path to connect the pressure release path and the pressure communicating part and a valve mechanism to open and close the pressure path, the valve mechanism comprising a cylindrical valve seat to contact a valve seat holding member, a valve to contact an inner diameter of the valve seat, an elastic member to press the valve against the valve seat, and a biasing pin inserted into the pressure path, an end of the biasing pin contacting the valve, the valve seat holding member having an opening through which the pressure path passes, the valve seat holding member provided on a wall surface of the holder opposite a wall surface thereof to be attached to the cylindrical holder mounting part, the fixing member fixing the holder to the cylindrical holder mounting part by being inserted into each of a mounting portion of the holder and a mounting portion of the cylindrical holder mounting part from a horizontal direction perpendicular to the positions of the hooks while the holder including the valve mechanism is inserted into the cylindrical holder mounting part; and the liquid droplet discharging head to discharge liquid droplets, wherein the liquid container and the liquid droplet discharging head are formed as a single integrated unit.

11. An image forming apparatus comprising:

a carriage; and a liquid droplet discharging device installed on the carriage to supply a liquid from a liquid container to a liquid droplet discharging head, the liquid droplet discharging device comprising:

the liquid container comprising:

a container body to store a liquid;

a pressure release mechanism to open and close a pressure release path in the container body; and a fixing member, the container body comprising:

the pressure release path to connect a release path and the pressure release mechanism;

a cylindrical holder mounting part having the pressure release path therein to which the pressure release mechanism is attached;

multiple hooks provided at vertically opposed positions outside the cylindrical holder mounting part with the cylindrical holder mounting part interposed therebetween; and the release path formed within the container body to release pressure from the container body, the pressure release mechanism comprising:

a pressure communicating part to communicate with air through a filter member; and a holder attached to the cylindrical holder mounting part, the holder comprising a pressure path to connect the pressure release path and the pressure communicating part and a valve mechanism to open and close the pressure path, the valve mechanism comprising a cylindrical valve seat to contact a valve seat holding member, a valve to contact an inner diameter of the valve seat, an elastic member to press the valve against the valve seat, and a biasing pin inserted into the pressure path, an end of the biasing pin contacting the valve, the valve seat holding member having an opening through which the pressure path passes, the valve seat holding member provided on a wall surface of the holder opposite a wall surface thereof to be attached to the cylindrical holder mounting part, the fixing member fixing the holder to the cylindrical holder mounting part by being inserted into each of a mounting portion of the holder and a mounting portion of the cylindrical holder mounting part from a horizontal direction perpendicular to the positions of the hooks while the holder including the valve mechanism is inserted into the cylindrical holder mounting part; and the liquid droplet discharging head to discharge liquid droplets, wherein:

the liquid container and the liquid droplet discharging head are formed as a single integrated unit; and the liquid droplet discharging head discharges ink onto a recording medium to form an image on the recording medium.

* * * * *